United States Patent [19]

Jackson

[11] Patent Number: 4,705,267

[45] Date of Patent: Nov. 10, 1987

[54] CONVERTIBLE WIND LOAD EXERCISE DEVICE

[76] Inventor: W. Shaun Jackson, 2860 Tessmer, Ann Arbor, Mich. 48103

[21] Appl. No.: 722,283

[22] Filed: Apr. 11, 1985

[51] Int. Cl.[4] ..... A63B 21/00; A63B 69/06; A63B 69/16

[52] U.S. Cl. ..... 272/134; 272/72; 272/73; 272/123

[58] Field of Search ..... 272/72, 73, 117, 118, 272/123, 73.1, 73.2, 134

[56] References Cited

U.S. PATENT DOCUMENTS

| | | | |
|---|---|---|---|
| 351,311 | 10/1886 | Conkling | 272/73 |
| 4,047,715 | 9/1977 | Gjessing | 272/72 X |
| 4,140,312 | 2/1979 | Buchmann | 272/134 X |
| 4,188,030 | 2/1980 | Hooper | 272/73 |
| 4,319,747 | 3/1982 | Rogers | 272/123 X |
| 4,382,596 | 5/1983 | Silberman | 272/134 X |
| 4,390,179 | 6/1983 | Szkalak | 272/134 X |
| 4,441,705 | 4/1984 | Browns | 272/73.1 |
| 4,564,193 | 1/1986 | Stewart | 272/73 X |
| 4,576,377 | 3/1986 | Wolff | 272/134 X |

FOREIGN PATENT DOCUMENTS

| | | | |
|---|---|---|---|
| 698353 | 1/1931 | France | 272/72 |
| 800087 | 6/1936 | France | 272/73 |

*Primary Examiner*—Richard J. Apley
*Assistant Examiner*—Robert W. Bahr
*Attorney, Agent, or Firm*—Krass & Young

[57] ABSTRACT

An exercise device intended to provide effective exercise for all major muscle groups of the human body. The device employs a bicycle wind trainer to provide lower body exercise, a rowing machine utilizing the rear wheel of the bicycle to provide upper body exercise, a bench press assembly to provide further upper body exercise, and a cable and weight assembly to provide further upper body exercise when used in conjunction with the bench.

13 Claims, 5 Drawing Figures

CONVERTIBLE WIND LOAD EXERCISE DEVICE

BACKGROUND OF THE INVENTION

This invention relates to exercise devices and more particularly to exercise devices intended to provide exercise for all major muscle groups in the body.

A myriad of exercise devices and machines have been proposed in the past to provide exercise for the human body. These prior art devices have either provided effective exercise only for some of the major muscle groups in the body or, if they have provided for exercise for all of the major muscle groups, have been unduly expensive and unduly complicated. Further, these prior art devices have provided primarily aerobic, or cardiovascular exercise, while providing little or no anaerobic, or muscle building exercise; or, alternatively, have provided primarily anaerobic exercise and little or no aerobic exercise.

BRIEF SUMMARY OF THE INVENTION

The present invention is directed to the provision of an exercise device that provides effective exercise for all major muscle groups of the body and which is yet extremely simple and relatively inexpensive.

The present invention is further directed to the provision of a simple and inexpensive exercise device that provides significant aerobic and anaerobic exercise for the human body.

The invention exercise device is based on the wind load trainers that are in common usage and wherein a bicycle is ridden in a stationary position and drives a fan or turbine so that the wind resistance encountered in actual cycling is simulated by the wind resistance generated by the fan. These devices provide excellent lower body exercise but totally fail to exercise the major muscle groups of the upper body. According to the invention, a basic wind load trainer is supplemented with a series of accessory exercise devices which coact with the basic wind load trainer to provide effective aerobic and anaerobic exercise for all major muscle groups of the body.

According to one aspect of the invention exercise device, the exercise device comprises a stand adapted to be positioned on a support surface; a blower assembly rotatably mounted on the stand and including at least one blower wheel and a drive roller; means on the stand for removably supporting a bicycle thereon with the tire of the rear wheel of the bicycle spaced above the support surface but frictionally engaging the drive roller so that a user pedalling the bicycle will drive the blower wheel to provide lower body exercise; a bench adapted to be removably secured at its one end to the stand with the bicycle removed and having leg means adjacent its other end sized to maintain the bench in a generally horizontal position when its one end is removably secured to the stand; and means on the stand for supporting the bar of a weight in spaced position over the bench so that a user lying on his back on the bench may repetitively press the weight to provide upper body exercise.

According to a further aspect of the invention, the stand further includes pulley means positioned above one end of the bench so that a user seted on the bench may raise and lower weights secured to a cable passing over the pulley by pulling on a handle secured to the free end of the cable.

According to a still further aspect of the invention, a rowing attachment is provided wherein the rear wheel of the bicycle is removed from the bicycle and positioned on the stand and a user positioned on the seat of the rowing attachment pulls on a chain trained over a sprocket wheel of the bicycle rear wheel to frictionally drive the blower wheel and thereby provide a simulated rowing load.

According to a further aspect of the invention, the legs on one end of the bench may be folded and the bench may be placed in an angled position on the stand so that a user may perform angled sit-ups on the bench or perform pressing exercises while disposed in an angled position.

DETAILED DESCRIPTION OF THE PREFERRED EMBODIMENT

Figure 1:
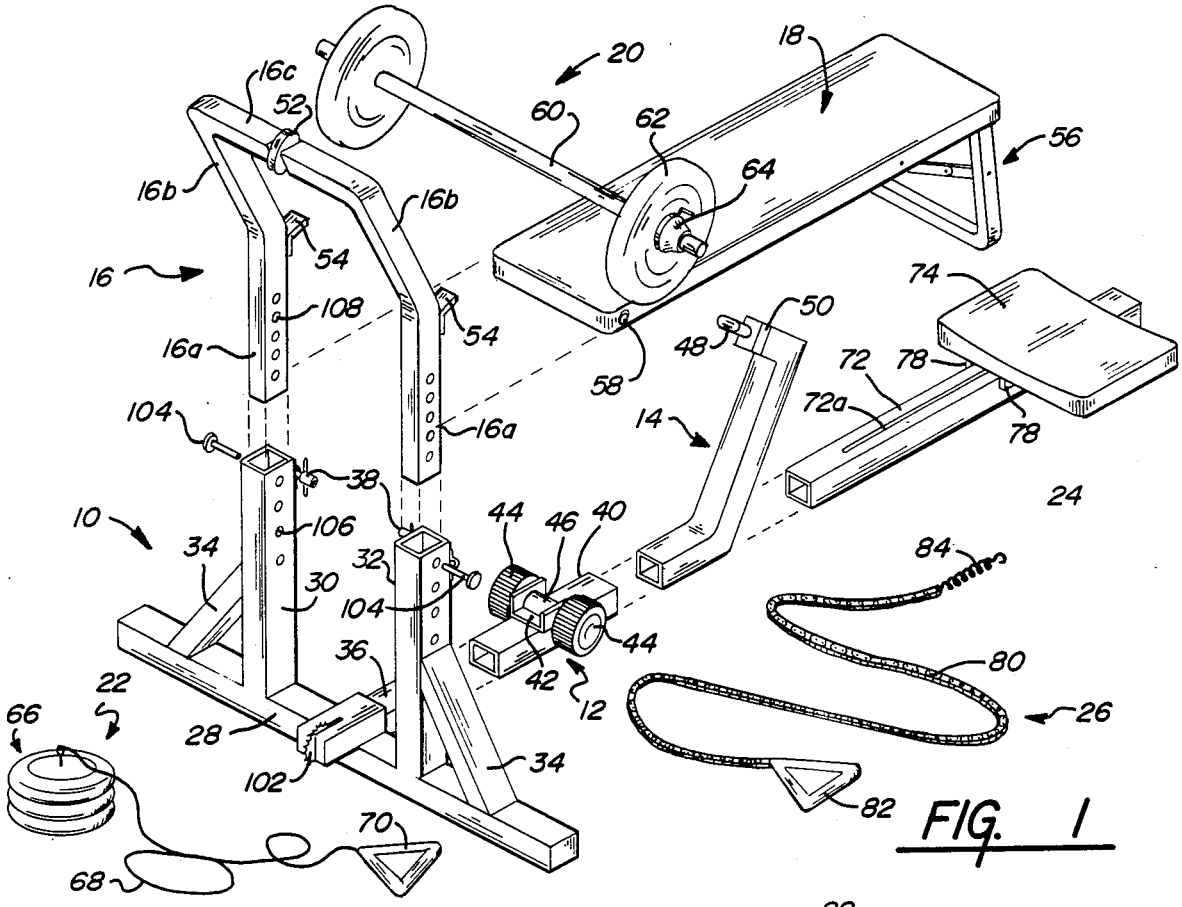
FIG. 1 is an perspective exploded view of the invention exercise device.

The invention exercise device, as best seen in FIG. 1, includes a stand 10; a blower assembly 12; a bicycle support member 14; a stand extension 16; a bench 18; a weight set 20; a further weight set 22; a rowing machine attachment 24; and a chain pull assembly 26 for use with rowing attachment 24.

Stand 10 is of tubular construction and includes a base member 28; a pair of spaced upright members 30 and 32; a pair of angled braces 34; a central stub member 36; and a pair of axle clamp members 38 adapted to engage the opposite ends of the rear axle of a bicycle.

Blower wheel assembly 12 includes a tubular support member 40 adapted to coact telescopically with central stub member 36; to form a forward extension of the stand a U-shaped mounting bracket 42 secured to the upper face of support member 40; a pair of blower wheels 44; a drive axle (not seen) drivingly interconnecting blower wheels 44; and a drive roller 46 concentrically positioned around the drive axle and drivingly fixed to the drive axle so that rotation of drive roller 46 rotates blower wheels 44.

Bicycle support member 14 includes a tubular support member 47 including a lower stand portion **47*a* for telescopic coaction with support member 40 and an upwardly and forwardly angled portion 47*b*. A J hook 48 and pad 50 are provided at the upper end of portion 47*b*** for coaction with the down tube of a bicycle.

Stand extension 16 is U-shaped and includes a pair of spaced lower leg portions **16*a* for telescopic, adjustable receipt in uprights 30,32; rearwardly angled portions 16*b*; and a transverse upper portion 16*c*. A pulley 52 is journalled in and by transverse portion 16*c* and a pair of brackets 54 are secured to the upper ends of leg portions 16*a* to form crotches with the adjacent surfaces of angled portions 16*b* for receipt of the bar of weight assembly 20**.

Bench 18 may be of any known construction and includes a collapsible leg assembly 56 adjacent one end and sockets 58 adjacent its other end.

Weight assembly 20 comprises a bar 60; weights 62 positioned at the ends of the bar; and clamping members 64 to secure weights 62 in position on the bar.

Weight assembly 22 includes a plurality of weights 66; a cable 68 attached at one end to weights 66; and a handle 70 attached to the other end of cable 68.

Rowing machine 24 comprises a tubular member 72 adapted for telescopic coaction with blower support member 40; a seat 74 mounted for sliding movement along tubular member 72; and a lug 75 depending from the underside of seat 74 and guiding in a central slot **72*a* in tubular member 72**.

Chain pull assembly 26 comprises a chain 80; a handle 82 secured to one end of chain 80; and a coil spring 84 secured to the other end of chain 80.

The various uses of the invention exercise device to provide total body exercise are illustrated in FIGS. 2–5.

Figure 2:
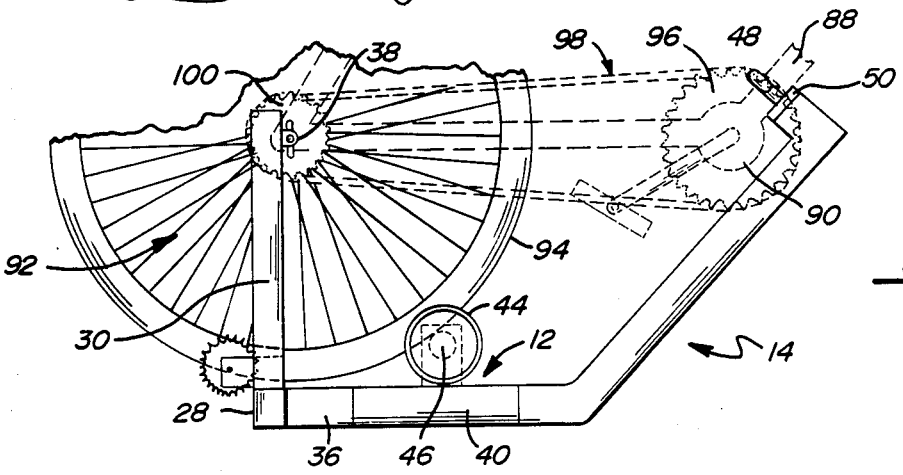
FIG. 2 is a fragmentary, somewhat schematic view of the invention exercise device in use as a bicycle wind load trainer.

In FIG. 2 the invention exercise device is shown in use as a bicycle wind load trainer. In this application, blower assembly 40 is telescopically secured to stub member 36; bicycle support member 14 is telescopically secured to tubular member 40; J hook 48 and clamp 50 coact to grasp the down tube 88 of the bicycle just above bottom bracket 90; axle clamps 38 engage the opposite ends of the rear axle of the rear wheel 92 of the bicycle and the tire 94 of the rear wheel frictionally engages roller drum 46 of blower wheel assembly 40. As a rider seated on the bicycle pedals the bicycle to rotate rear wheel 92 via chain ring 96, chain 98, and rear sprocket 100, the tire 94 frictionally drives drive roller 46 to rotate blower wheels 44 and provide a simulated wind load for the cyclist. This provides excellent lower body, primarily aerobic exercise.

Figure 3:
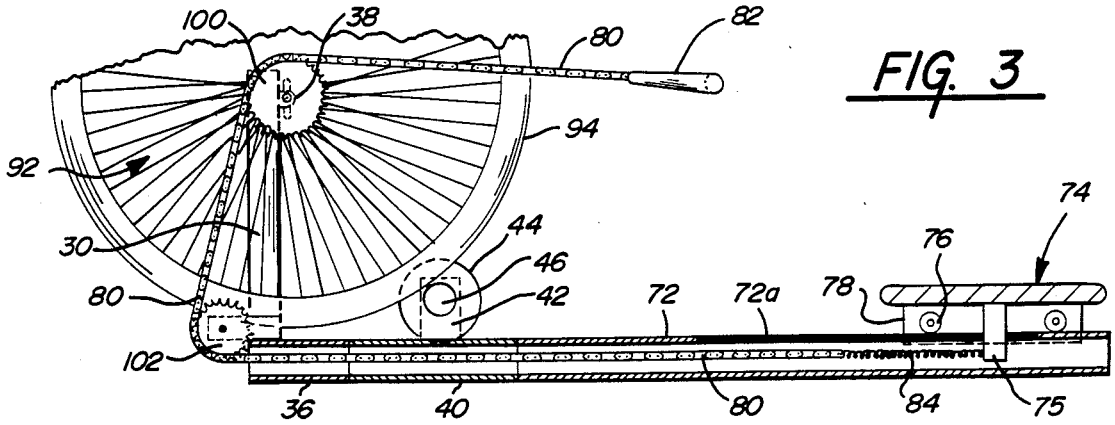
FIG. 3 is a fragmentary, somewhat schematic view of the invention exercise device in use as a rowing machine.

The use of the invention exercise device as a rowing machine is seen in FIG. 3. In this application, bicycle support member 14 is removed; rowing machine tubular member 72 is telescopically received on blower wheel support member 40; the rear wheel 92 of the bicycle is removed from the bicycle and is positioned between axle clamps 38; and the free end of spring 84 of chain pull assembly 26 is secured to lug 75 of rowing machine seat 74 with the spring 84 and chain 80 extending forwardly within aligned tubular members 72, 40 and 36 and then passing upwardly over a sprocket 102 secured centrally to base member 28 and then passing upwardly and around the rear sprocket 100 of the bicycle rear wheel 92 to dispose the handle 82 of chain device 26 in a position to be engaged by a user seated on rowing machine seat 74. As the user pulls rearwardly on handle 82, the rear wheel of the bicycle is rotated to spin blower wheels 44 so that as the user slides to and fro along support member 72 while alternately pulling on and releasing chain member 80, blower wheels 40 are spun at a high speed to provide a wind load that simulates the loading encountered in actual rowing and provides excellent upper body, primarily aerobic exercise.

Figure 4:
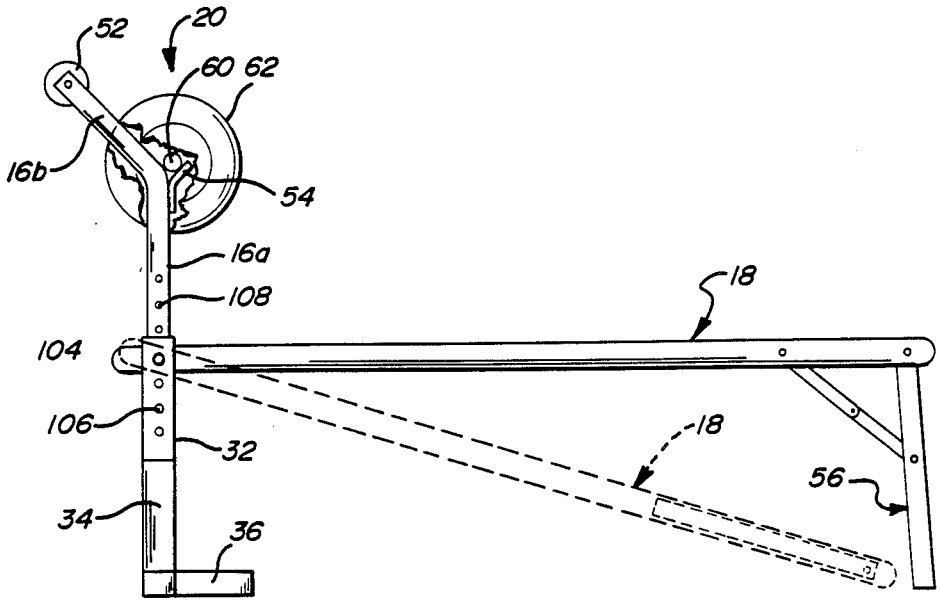
FIG. 4 is a somewhat schematic view of the invention exercise device in use as a bench press.

The invention exercise device is seen in FIG. 4 in use as a bench press. In this application, leg portions **16*a* of stand extension 16 are positioned telescopically within uprights 30,32 of stand 10 with pins 104 passing through aligned holes 106 and 108 in stand 10 and stand extension 16 to selectively and adjustably position stand extension 16 telescopically within stand 10; and bench 18 is mounted to stand 10 by passing the inner ends of pins 104 into bench sockets 58 so that bench 18 is positioned at one end between uprights 30 and 32 and is maintained in a generally horizontal position by collapsible leg assembly 56. In use, a user lying on his back on bench 18 may grasp and push upwardly on the bar 60 of the weight assembly 20 positioned in the crotch defined by brackets 54, lower the weight assembly to his chest, and perform repetitive pressing exercises with the weight assembly to provide upper body exercise which may be primarily anaerobic if performed with heavy weights and few repetitions or primarily anaerobic if performed with light weights and many repetitions. Alternativelyl, leg assembly 56 may be collapsed and the bench positioned in the downwardly angled position seen in dotted lines in FIG. 4. In its downwardly angled position, the user may perform the repetitive pressing exercise using weight 20** or may position himself on his back with his head down on the bench and perform angled sit-ups whereby to provide abdominal muscle exercise.

Figure 5:
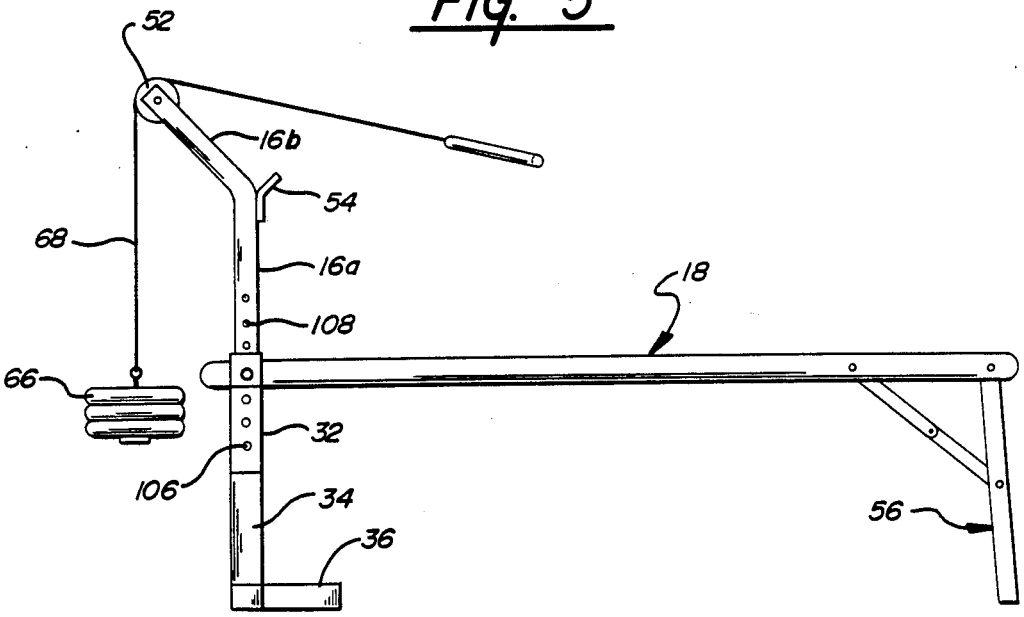
FIG. 5 is a somewhat schematic view of the invention exercise device in use to provide various other upper body exercises.

The invention exercise device is seen in FIG. 5 configured to provide various upper body exercises employing bench 18 and weight set 22. In this application, the bench is positioned as described with reference to the FIG. 4 application and the cable 68 of the weight set 22 is trained over pulley 52 to position handle 70 adjacent a user seated either forwardly facing or rearwardly facing on bench 18 so that the user may pull on the handle in various ways to provide various upper body exercises with the weights 66 providing the resistance for the various exercises. Again, the exercise may be primarily anaerobic if performed with heavy weights and few repetitions or primarily aerobic if performed with light weights and many repetitions.

The invention exercise device will thus be seen to provide a relatively inexpensive and a relatively simple device that provides effective aerobic and anaerobic and exercise for all major muscle groups of the body.

Whereas a preferred embodiment of the invention has been illustrated and described in detail, it will be apparent that various changes may be made in the preferred embodiment without departing from the invention.

I claim:

1. An exercise device comprising:

(A) a stand adapted to be positioned on a support surface and including a generally horizontal member adapted to be supported on the support surface and a generally vertical member extending upwardly from said horizontal member;

(B) a blower assembly rotatably mounted on said stand and including at least one blower wheel and a drive roller;

(C) bicycle mounting means on said stand for removably supporting a bicycle of the type including a rear wheel including a rear axle, a tire mounted on the rear wheel, and a pedal system for driving the rear wheel, said bicycle mounting means including means on said upright member for engaging the rear axle of the bicycle and being operative to support the bicycle on said stand in a position with the tire of the rear wheel of the bicycle is spaced above the support surface but frictionally engages said drive toller so that a user pedalling the bicycle will drive the rear wheel of the bicycle and thereby said blower wheel to simulate a wind load and provide lower body exercise;

(D) a bench having means at one end for removably securing said one end to said vertical member, with the bicycle removed, and having leg means adjacent its other end sized to maintain said bench in a generally horizontal position when its one end is removably secured to said vertical member; and (E) means on said vertical member for supporting a bar in spaced position over said one end of said bench so tht, with weights attached to the opposite ends of the bar, a user lying on his back on said bench may repetively press the bar and attached weights to provide upper body exercise.

2. An exercise device according to claim 1 wherein:

F. said leg means are collapsible and said one end of said bench is pivotally mounted to said vertical member so that said leg means may be collapsed and the bench may be pivoted to a downwardly inclined position with the other end supported on the support surface to provide an inclined bench for angled sit-ups, inclined bench pressing and the like.

3. An exercise device comprising:

(A) a stand adapted to be positioned on a support surface and including a pair of laterally spaced upright assemblies;

(B) a blower assembly rotatably mounted on said stand and including at least one blower wheel and a drive roller;

(C) bicycle mounting means on said stand for removably supporting a bicycle of the type including a rear wheel, a tire mounted on the rear wheel, and a pedal system for driving the rear wheel, said bicycle mounting means comprising means on said upright assemblies for respectively engaging the opposite ends of the rear axle of the bicycle and being operative to support the bicycle on said stand in a position where the tire of the rear wheel of the bicycle is spaced above the support surface but frictionally engages said drive roller so that a user pedalling the bicycle will drive the rear wheel of the bicycle and thereby said blower wheel to simulate a wind load and provide lower body exercise;

(D) a bench having means at one end for removably securing said one end to said stand, with the bicycle removed, and having leg means adjacent its other end sized to maintain said bench in a generally horizontal position when its one end is removably secured to said stand; and (E) means on said upright assembly above said bicycle support means for supporting a bar at laterally spaced locations thereon and in spaced position over said one end of said bench so that, with weights attached to the opposite ends of the bar, a user lying on his back on said bench may repetively press the bar and attached weights to provide upper body exercise.

4. An exercise device according to claim 3 wherein:

I. each of said upright assemblies comprises a lower hollow portion and an upper portion telescopically and adjustably received in said lower hollow portion.

5. An exercise device according to claim 4 wherein:

(J) said stand further includes a laterally extending base member;

(K) said device further includes a support member assembly extending forwardly from said base member;

(L) said lower portions of said upright assemblies are fixedly secured at their lower ends to laterally spaced locations on said base member;

(M) means are provided on the forward end of said support member assembly for releasably engaging a portion of the bicycle forwardly of the bicycle rear wheel; and (N) said blower wheel is rotatably mounted on said support member assembly between said base member and said releasable engaging means.

6. An exercise device according to claim 5 wherein:

O. said releasably engaging means engages the down tube of the bicycle just above the bottom sprocket.

7. An exercise device comprising:

(A) a stand adapted to be positioned on a support surface;

(B) a blower assembly rotatably mounted on said stand and including at least one blower wheel and a drive roller;

(C) bicycle mounting means on said stand removably supporting a bicycle of the type including a rear wheel, a tire mounted on the rear wheel, and a pedal system for driving the rear wheel, said bicycle mounting means being operative to support the bicycle on said stand in a position where the tire of the rear wheel of the bicycle is spaced above the support surface but frictionally engages said drive roller so that a user pedalling the bicycle will drive the rear wheel of the bicycle and thereby said blower wheel to simulate a wind load and provide lower body exercise;

(D) a bench having means at one end for removably securing said one end to said stand, with the bicycle removed, and having leg means adjacent its other end sized to maintain said bench in a generally horizontal position when its one end is removably secured to said stand;

(E) means on said stand for supporting a bar in spaced position over said one end of said bench so that, with weights attached to the opposite ends of the bar, a user lying on his back on said bench may repetively press the bar and attached weights to provide upper body exercise; and (F) means on said stand rotatably mounting a pulley in spaced position over and behind said one end of said bench so that a user sitting on the bench facing said one bench end may selectively lift weights attached to a cable trained over said pulley by pulling on a handle attached to the other end of the cable.

8. An exercise device comprising:

(A) a stand adapted to be positioned on a support surface;

(B) a blower assembly rotatably mounted on said stand and including at least one blower wheel and a drive roller;

(C) wheel mounting means on said stand for removably and rotatably supporting a bicycle rear wheel assembly of the type including a drive sprocket, an axle, a wheel mounted on the axle, and a tire mounted on the wheel, said wheel mounting means engaging the rear axle of the bicycle rear wheel assembly and being operative to mount the bicycle rear wheel assembly on said stand in a position where the tire of the rear wheel assembly is spaced above the support surface but frictionally engages said drive roller so that rotation of the bicycle rear wheel assembly drives said blower wheel;

(D) a rowing attachment comprising an elongated frame member adapted to be secured to said stand and a seat mounted for reciprocal movement along said frame member; and (E) a chain assembly comprising a handle and a chain secured at one end to said handle and adapted to be passed over the sprocket of the bicycle rear wheel assembly for attachment at its other end to a suitable resistance so that a user may pull on the handle to spin the rear wheel assembly and rotate said blower wheel to provide resistance to the pulling action.

9. An exercise device according to claim 8 wherein:

(F) the other end of said chain is attached to said seat so that a user seated on the seat of the rowing attachment may pull on said handle while moving reciprocally with said seat on said frame member to provide a simulated wind load resistance to the rowing action.

10. An exercise device according to claim 9 wherein:

(G) said frame member comprises a longitudinally extending tubular member; and (H) said chain, afater passing over the drive sprocket of the rear wheel assembly, extends through the hollow of said tubular member for attachment at its other end to said seat of said rowing attachment.

11. An exercise device comprising:

(A) a frame structure;

(B) a blower wheel assembly mounted on said frame structure and including a drive roller and at least one blower wheel drivingly connected to said driver roller;

(C) wheel mounting means on said frame for mounting a bicycle rear wheel assembly of the type including a drive sprocket, an axle, a wheel, and a tire mounted on the wheel, said mounting means engaging the axle of the bicycle rear wheel assembly and being operative to support the bicycle rear wheel assembly on said frame in a position where the central axis of the rear wheel is horizontally disposed, the wheel is free to rotate about said axis, and the tire of the wheel is frictionally driving said drive roller;

(D) a seat mounted on said frame structure for reciprocal movement along a path extending generally normal to said axis; and (E) a chain drive assembly including a chain member adapted to be trained over the drive sprocket of the bicycle rear wheel assembly, a handle connected to one end of the chain member and adapted to be grasped by a user seated on said seat, and means connecting the other end of said chain member to said seat so that the user may pull on said handle while moving on said seat along said path and said blower wheel will be rotated to provide a simulated rowing load.

12. An exercise device according to claim 11 wherein:

F. said bicycle rear wheel mounting means on said frame comprises a pair of laterally spaced uprights and clamping means on said uprights for respectively engaging the opposite ends of the rear axle of the bicycle wheel; and G. the projection of said path extends between said uprights.

13. An exercise device according to claim 12 whrein:

H. said frame structure includes a laterally extending base member;

I. said spaced uprights are fixedly secured at their lower ends to said base member;

J. said frame structure further includes an elongated frame member intersecting said base member in T fashion between said spaced uprights.

K. said seat is mounted for reciprocal movement along said elongated frame member; and L. said blower wheel assembly is mounted on said elongated frame member between said seat and said base member.

* * * * *